US005423481A

United States Patent [19]

Thomas

[11] Patent Number: 5,423,481

[45] Date of Patent: Jun. 13, 1995

[54] MENISCUS REGULATOR SYSTEM

[75] Inventor: Marshall K. Thomas, Philadelphia, Pa.

[73] Assignee: The United States of America as represented by the Secretary of the Navy, Washington, D.C.

[21] Appl. No.: 123,944

[22] Filed: Sep. 20, 1993

[51] Int. Cl.[6] ..... B05B 1/02

[52] U.S. Cl. ..... 239/1; 239/71; 239/101

[58] Field of Search ..... 239/1, 11, 71, 99, 101

[56] References Cited

U.S. PATENT DOCUMENTS

| | | | |
|---|---|---|---|
| 3,343,794 | 9/1967 | Voitsekhovsky | 239/101 |
| 3,653,596 | 4/1972 | Abrams et al. | 239/101 X |
| 3,848,118 | 11/1974 | Rittberg | 239/101 |
| 3,924,805 | 12/1975 | Nebeker et al. | 239/1 |

FOREIGN PATENT DOCUMENTS

| | | | |
|---|---|---|---|
| 318691 | 12/1971 | U.S.S.R. | 239/101 |

OTHER PUBLICATIONS

The Instruction Manual for An Impact Apparatus developed by The Cambridge Laboratory in Cambridge, England.

*Primary Examiner*—Andres Kashnikow
*Assistant Examiner*—Lesley D. Morris
*Attorney, Agent, or Firm*—James V. Tura; Susan E. Verona

[57] ABSTRACT

A method and system is provided for regulating the meniscus of a water droplet in a high velocity water droplet apparatus in which a large pulse of energy are applied to the water droplet to propel the water droplet at high velocity. In this method the shape of the meniscus of the water droplet is observed and adjusted in accordance with the observation. The energy is applied to the water droplet substantially simultaneously with the observing of the shape of the meniscus. The shape of the meniscus is determined by observing a magnified image of the water droplet so that the adjustment may be made in accordance with the magnified image. The high energy is applied to the water droplet by means of a projectile and an energy transfer body which transfers energy from the projectile to the water droplet. A pressure adjustment device is provided for adjusting the pressure applied to the water droplet in order to adjust the meniscus.

20 Claims, 6 Drawing Sheets

MENISCUS REGULATOR SYSTEM

STATEMENT OF GOVERNMENT INTEREST

The invention described herein may be manufactured and used by and for the Government of the United States of America for Governmental purposes without payment of any royalties thereon or therefor.

FIELD OF THE INVENTION

This invention relates to the field of materials testing and, in particular, to equipment for testing the resistance to erosion of materials.

BACKGROUND OF THE INVENTION

Objects traveling through the atmosphere at high velocity may be subjected to high energy impacts from liquid droplets in the air. These liquid droplets may cause severe erosion of the surface of the object. If the object is a vehicle, this may lead to failure of components such as windows and sensors because they may be formed of materials which are more brittle and weaker than the metals forming the remainder of the vehicle. These weaker materials are often selected for use on these vehicles primarily because of their optical or electromagnetic properties rather than for their resistance to erosion.

Therefore, it is desirable to study the resistance to this type of erosion for different materials having the required electromagnetic properties. A liquid jet impact apparatus was developed by The Cavendish Laboratory, Cambridge, England, for this purpose. The Cavendish Laboratory apparatus is capable of firing a single drop of water with well controlled shape, size and velocity at a sample of material to be evaluated. This permits experimentation to develop a fundamental understanding of the damage mechanisms in the kinds of materials commonly used on windows and sensors of high velocity vehicles. It also permits evaluation of potential improvements in the erosion resistance of these materials.

Referring now to FIG. 1, there is shown a portion of a prior art liquid jet impact apparatus 10. In prior art liquid jet impact apparatus 10 projectile 32 is propelled at a high velocity toward metal block 28 and strikes metal block 28 thereby transferring energy to metal block 28. The energy of this impact is transmitted from energy transfer metal block 28 to steel piston 24 and neoprene gasket 22 which are thereby forced into impact water chamber 20. Impact water chamber 20 contains water.

The energy transmitted from projectile 32 to steel piston 24 forces water within impact water chamber 20 through liquid jet nozzle 14 thereby forcing water droplet 12 to exit nozzle 14 at a high velocity toward a material to be evaluated for resistance to erosion. The proper curvature of the meniscus of high velocity water droplet 12 at the time it exits liquid jet nozzle 14 is important for providing reproducible test results using prior art liquid jet impact apparatus 10.

Referring now to FIGS. 2A,B,C, there are shown cross-sectional representations of water droplets 34, 36, 38 extending from liquid jet nozzle 14. Water droplets 34, 36, 38 are formed by adjusting the pressure against metal block 28 and thereby the pressure in water chamber 20. The pressure against steel piston 24 may be adjusted by adjusting metal block 28 manually. This type of adjustment sometimes resulted in a meniscus on water droplet 12 which was relatively stable but was formed with too large a projection from liquid jet nozzle 14 as shown in FIG. 2A with respect to water droplet 34. This large projection from nozzle 14 resulted in an unsatisfactory water droplet 12 being propelled toward the material being tested.

Alternately, the projection of water droplet 12 from liquid jet nozzle 14 could be too small when the pressure against steel piston 24 was determined by adjusting metal block 28 manually. If water droplet 12 was too small, as shown in FIG. 2B with respect to water droplet 36, it could recede back into liquid jet nozzle 14. When liquid droplet 12 receded into nozzle 14 a spray rather than drop formation was propelled toward the material being tested when prior art: liquid jet impact apparatus 10 was fired. Using manual adjustment it was very difficult to provide a well formed water droplet such as water droplet 38, shown in FIG. 2C, within prior art impact apparatus 10.

Thus, within prior art liquid jet impact system 10 there was no precise control of the shape of the meniscus of water droplet 12 even though it is now believed that the shape of the meniscus of water droplet 12 is important for controlling the shape, size and velocity of droplet 12 when fired. Furthermore, it was not possible in liquid jet impact system 10 to adjust the meniscus between the time that water chamber 20 was closed and the time when projectile 32 was fired toward energy transfer metal block 28. This time period is believed to be critical because water droplet 12 protruding from liquid jet nozzle 14 may recede over a relatively short period of time thereby changing the shape of the meniscus. Additionally, it was very difficult to learn how to use prior art impact apparatus 10.

SUMMARY OF THE INVENTION

A method and system are provided for regulating the meniscus of a water droplet in a high velocity water droplet apparatus in which a large pulse of energy is applied to the water droplet to propel the water droplet at high velocity. In this method the shape of the meniscus of the water droplet is observed and adjusted in accordance with the observation. The energy is applied to the water droplet substantially simultaneously with the observing of the shape of the meniscus. The shape of the meniscus is determined by observing a magnified image of the water droplet so that the adjustment may be made in accordance with the magnified image. The high energy is applied to the water droplet by means of a projectile and an energy transfer body which transfers energy from the projectile to the water droplet. A pressure adjustment device is provided for adjusting the pressure applied to the water droplet in order to adjust the meniscus.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
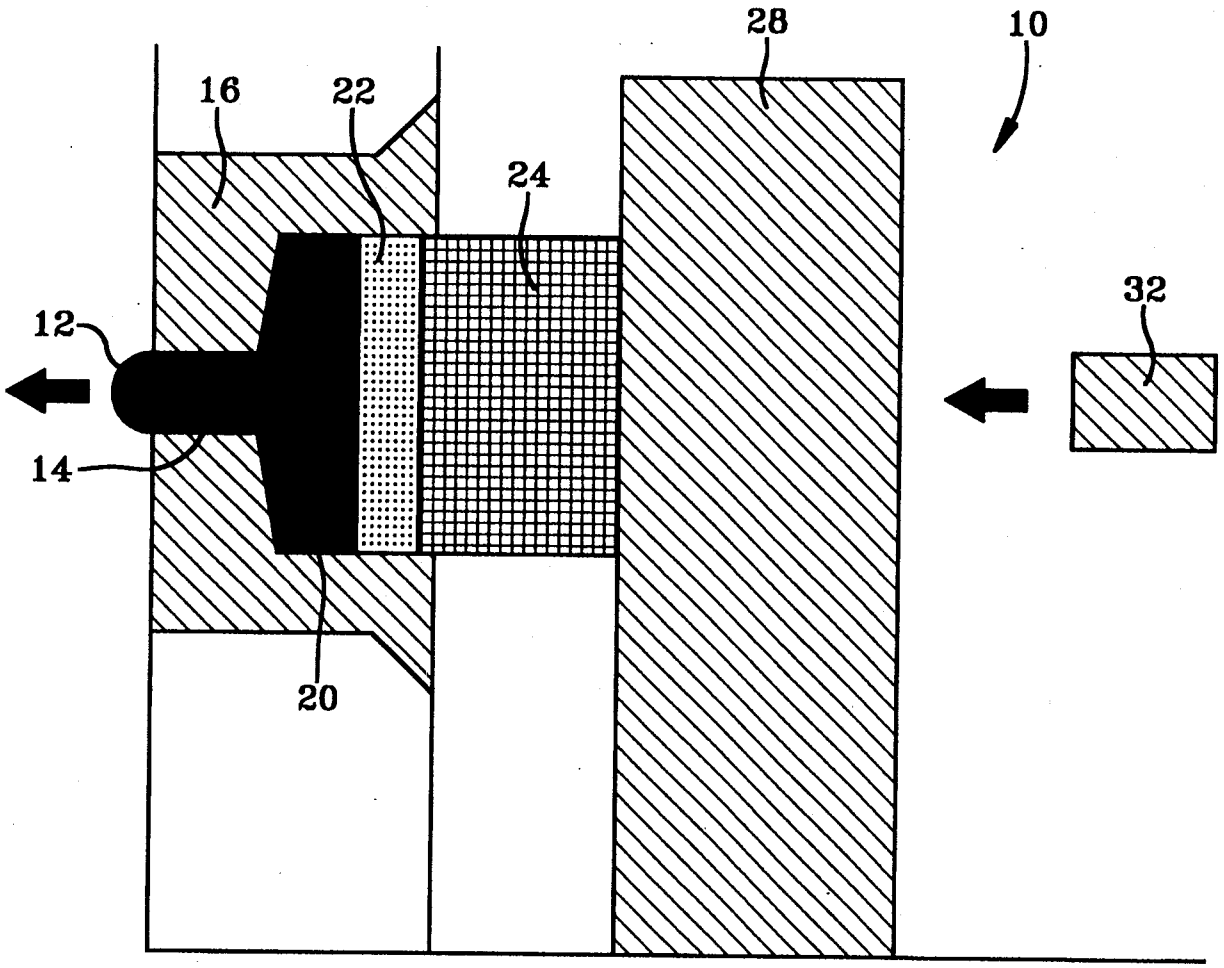
FIG-1 PRIOR ART
FIG. 1 is a cross-sectional representation of a prior art liquid jet impact apparatus.
Figure 2C:
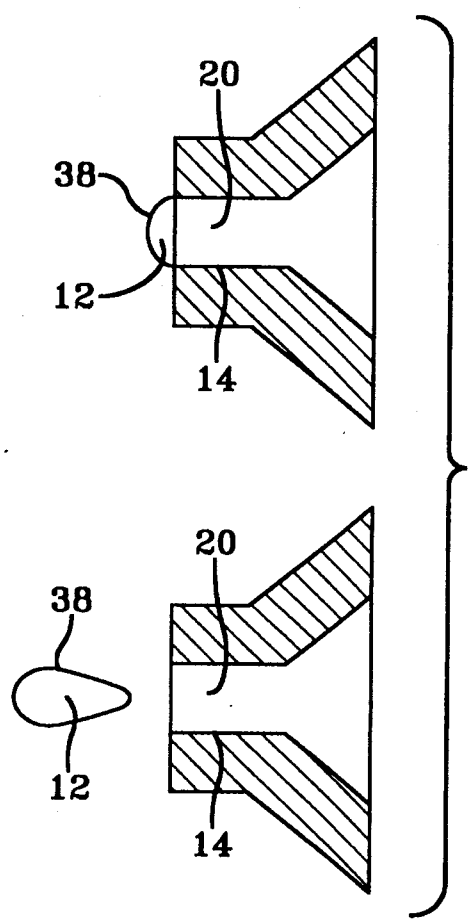
FIG-2C PRIOR ART
FIGS. 2A,B,C are cross-sectional representations of various water droplets which may be formed using the prior art liquid jet impact system of FIG. 1.
Figure 2B:
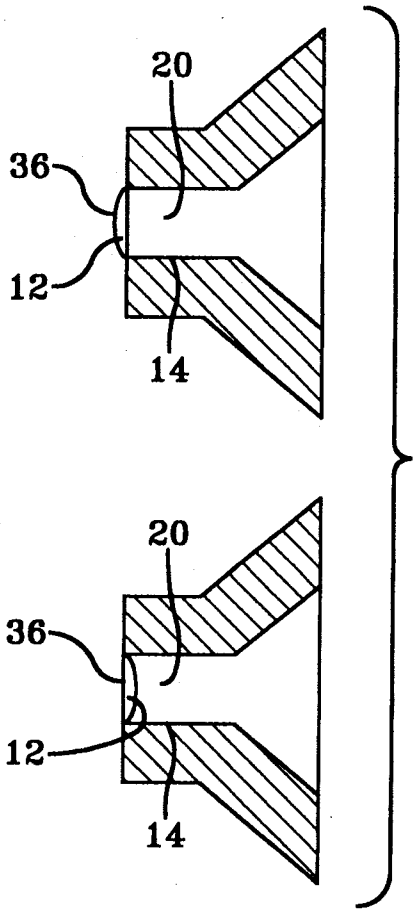
FIG-2B PRIOR ART
Figure 2A:
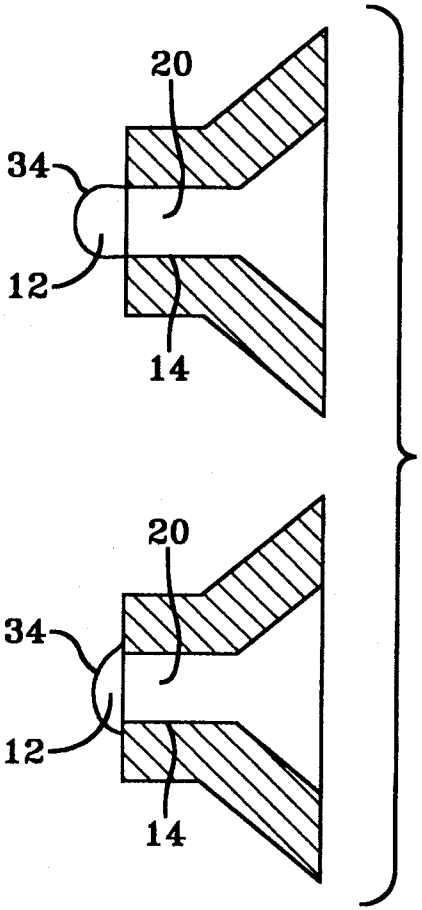
FIG-2A PRIOR ART
Figure 3:
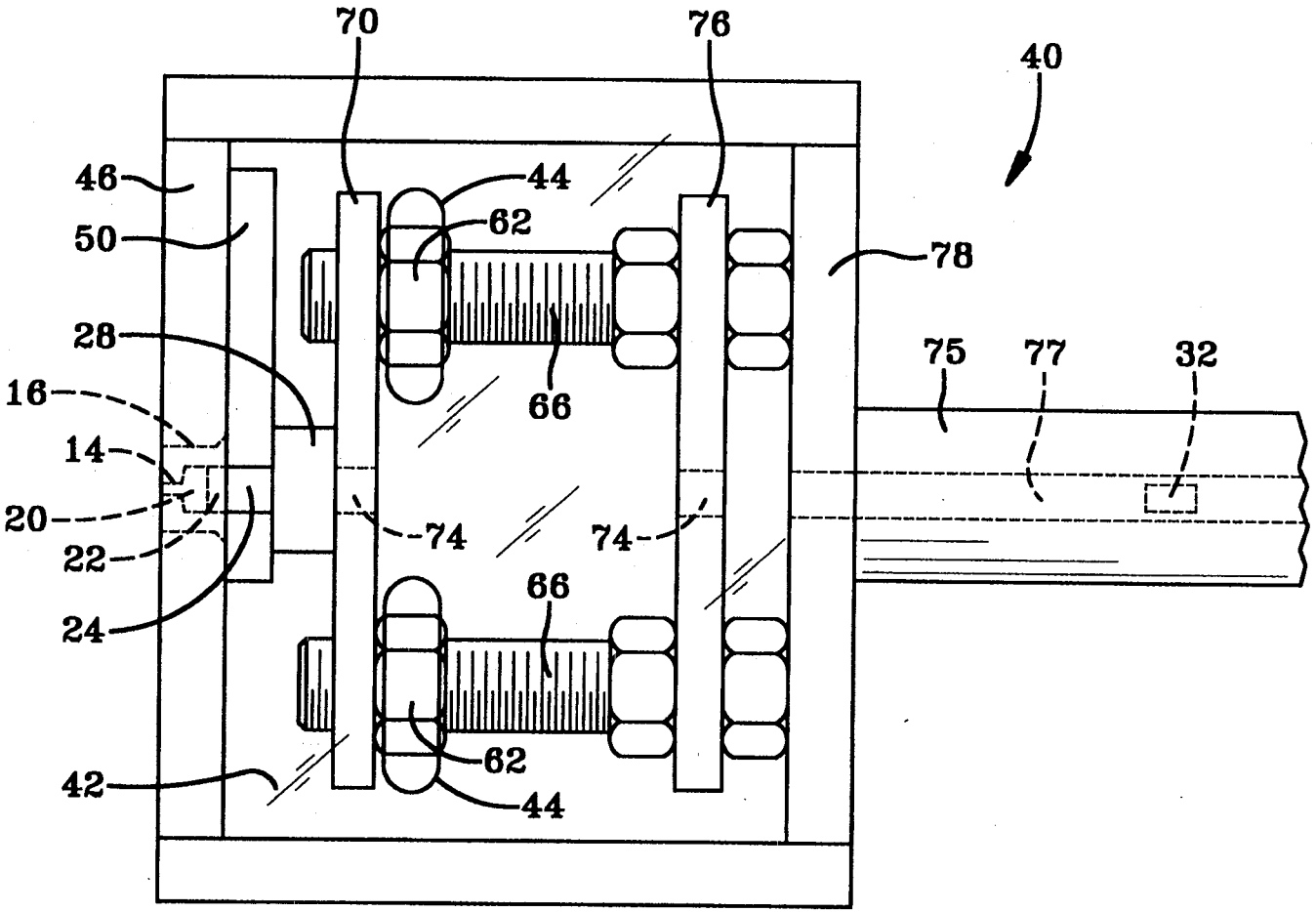
FIG. 3 is a fragmentary top view of the meniscus regulator system of the present invention.
Figure 4:
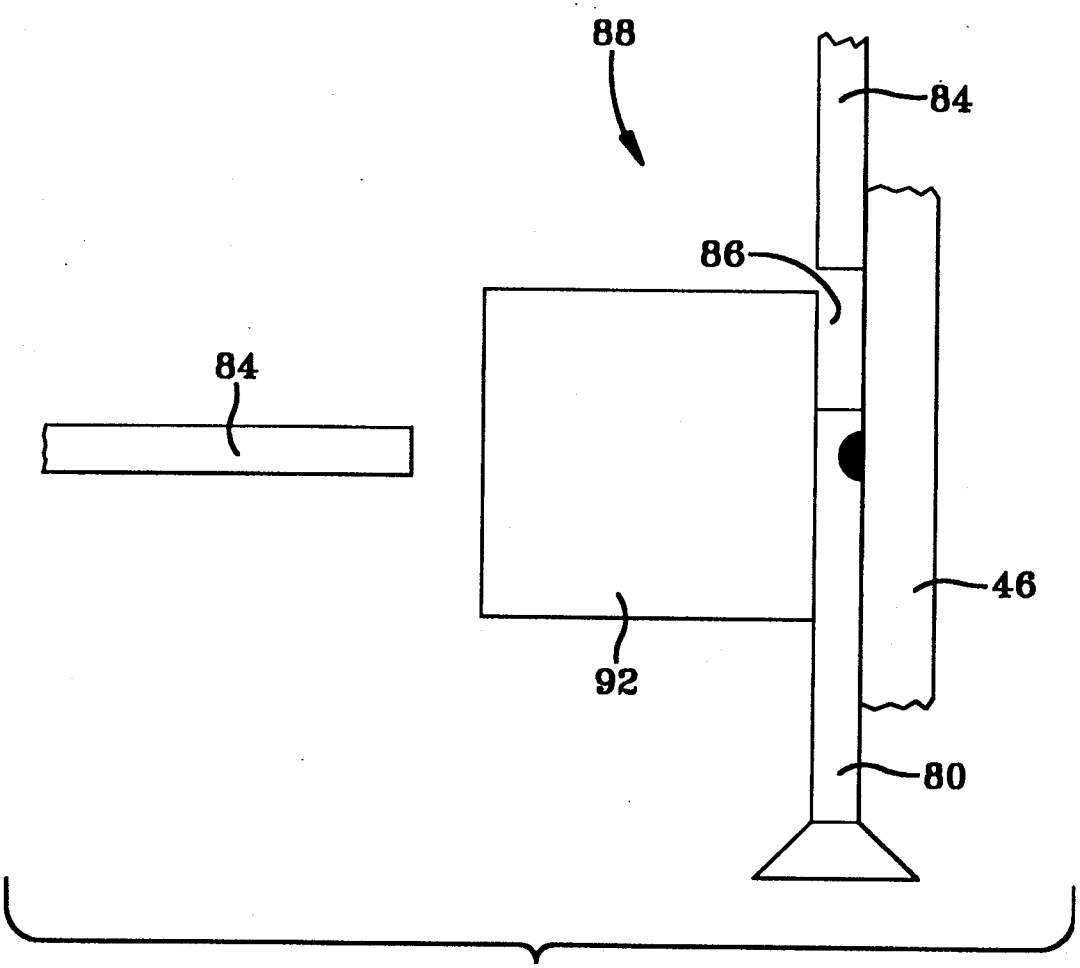
FIG. 4 is a fragmentary top view of the optical viewing system of the present invention.
Figure 5:
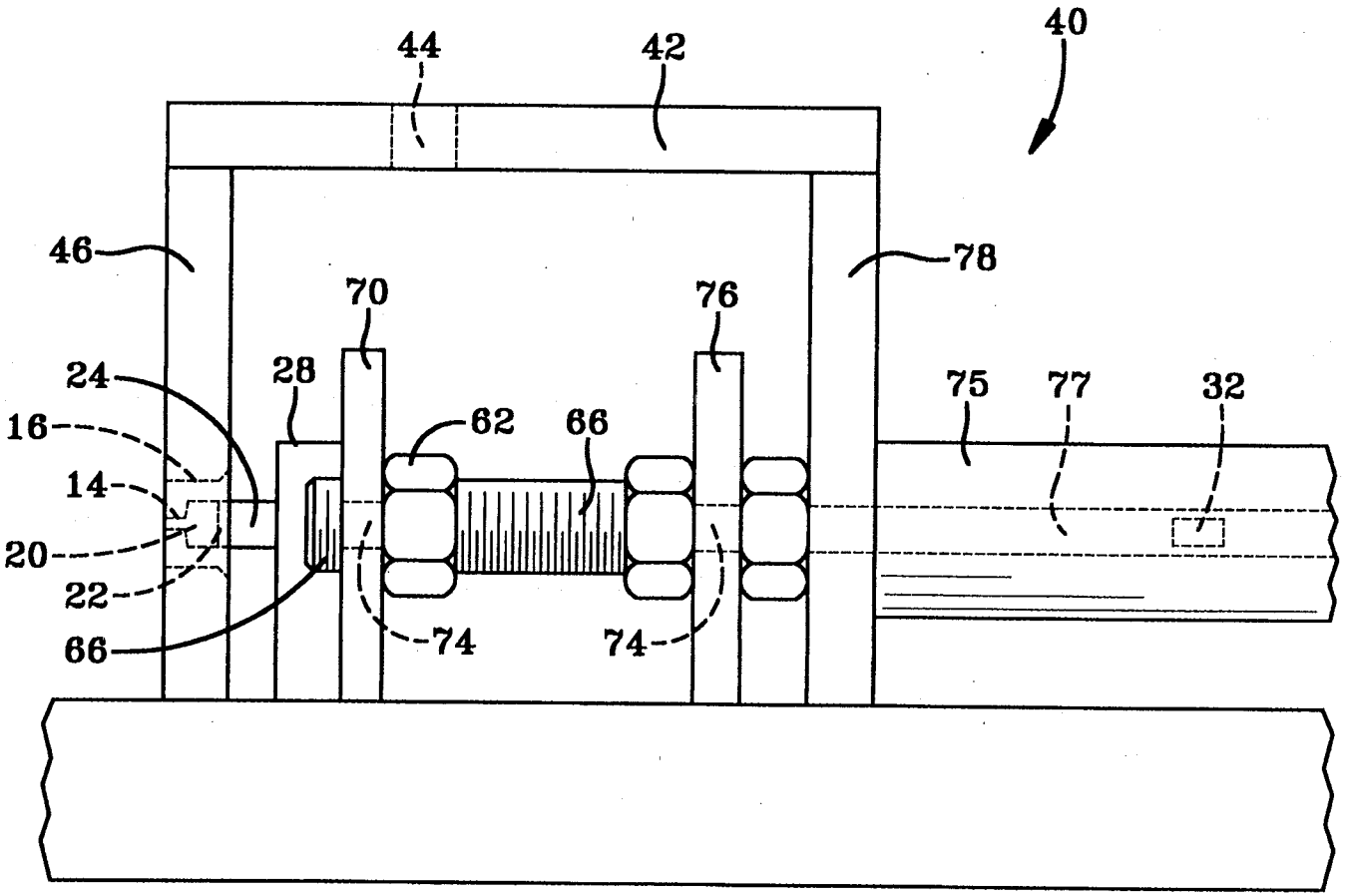
FIG. 5 is a fragmentary side view of the meniscus regulator system of the present invention.

Referring to the drawings, wherein the same reference numerals are used to designate the same elements throughout, there are shown in FIGS. 3, 4 fragmentary top views of high velocity droplet meniscus regulator system 40 of the present invention. Referring to FIG. 5, there is shown a fragmentary side view of meniscus regulator system 40. High velocity droplet meniscus regulator system 40 includes temporary support 50 for steel cylinder 24, transparent cover plate 42 having openings 44 for viewing and adjusting meniscus regulator system 40, and optical viewing system 88 for viewing high velocity water droplet 12 prior to firing of projectile 32. Optical viewing system 88 includes light sources 84 and boroscope 80 for illuminating and observing water droplet 12 right up until the firing of projectile 32. It will be understood by those skilled in the art that optical viewing system 88 provides a magnified view of the meniscus of water droplet 12.

Prior to disposing liquid jet nozzle 14 in meniscus regulator system 40, liquid jet nozzle 14 is loaded with water usually using a hypodermic needle. When all air is displaced the excess water is wiped off. The dry edge of neoprene gasket 22 is positioned slightly inside the opening of impact water chamber 20. Air is excluded from impact water chamber 20 and liquid jet nozzle 14 during this procedure. Liquid jet nozzle 14 is then ready to be disposed in a bevelled hole 16 which is bored in shield 46 of meniscus regulator system 40.

Temporary cylinder support 50, preferably formed of a suitable elastic material, is placed under steel cylinder 24 or steel piston 24 in order to support steel piston 24 during the preparation process. The elastic material of temporary piston support 50 should preferably have a thickness slightly less than the distance between safety shield 46 and metal block 28 which is placed against projecting steel piston 24. In this manner cylinder support 50 may serve as a spacer controlling how far steel piston 24 extends into impact chamber 20 as well as serving as a support member. Metal block 28 is then positioned against steel piston 24.

Meniscus regulator system 40 is then placed between safety shields 46, 78. It will be understood that in the preferred embodiment of meniscus regulator system 40 safety shields 46, 78 are part of a steel box (not shown) having four integral sides. The steel box formed thereby is placed upon a steel base (not shown). As previously described, cover plate 42 is disposed on top of the steel box thereby completely surrounding meniscus regulator system 40. This is done because projectile 32 may be smashed into many high velocity pieces upon impact with metal block 28.

Meniscus regulator system 40 also includes adjustable pressure plate 70 which applies and maintains an adjustable pressure against energy transfer metal block 28. The pressure applied to metal block 28 by pressure plate 70 is precisely adjusted within meniscus regulator system 40 in order to maintain an optimum meniscus on water droplet 12 protruding from liquid jet nozzle 14.

Rotatably advanced adjusting nuts 62 surround threaded bolts 66 and are positioned against adjustable pressure plate 70. Threaded bolts 66 are supported by support plate 76. Pressure plate 70 is positioned and advanced by rotating adjusting nuts 62 to apply the correct pressure to support steel cylinder 24. Elastic support piece 50 may then be removed from high velocity droplet meniscus regulator system 40.

The formation of water droplet 12 may be observed using boroscope 80 of optical viewing system 88 or any other optical system known to those skilled in the art. When sample holder assembly 92 for containing a material to be tested is placed in front of nozzle 14 of the meniscus regulator system 40 illumination may be provided by light sources such as fiber optic light sources 84. Sample holder assembly 92 may be a teflon block in a brass fixture and may be threadably secured to safety shield 46 during the firing of projectile 32. Within meniscus regulator system 40 sample holder 92 is offset from safety shield 46 a distance 86 in order to permit observation of the meniscus of water droplet 12 using boroscope 80. The offset distance 86 also permits fiber optic light source 84 to .apply light to the meniscus of water droplet 12.

In an alternate embodiment of meniscus regulator system 40 (not shown) sample holder 92 is not offset from safety shield 46. Rather, openings (not shown) may be drilled in the rear and side of sample holder 92 in order to permit the positioning of fiber optic light source 84 to transmit light therethrough in order to observe water droplet 12 from the rear of sample holder 92. It will be understood that in this case, the opening on the side of sample holder 92 is required for the boroscope 80 to pass therethrough. In applications where adequate lighting is provided by boroscope 80, additional lighting by light sources such as fiber optic light sources 84 is not necessary.

In order to form high velocity water droplet 12 in meniscus regulator system 40, adjusting nuts 62 on threaded bolts 66 are turned evenly until the meniscus appears at the outlet of liquid jet nozzle 14. Excess water is removed from the vicinity of liquid jet nozzle 14 if water droplet 12 collapses. Transparent cover plate 42 or cover assembly 42 may then be disposed upon safety shields 46, 78 as previously described.

Meniscus regulator system 40 is provided with transparent plastic cover plate 42 in order to permit viewing of meniscus regulator system 40 while adjusting the meniscus of water droplet 12 and to permit general inspection of system 40. It will be understood by those skilled in the art that plastic cover plate 42 replaces the conventional steel cover plates of prior art liquid jet impact systems such as jet impact system 10.

Transparent cover plate 42 is provided with an individual opening 44 positioned above each adjusting nut 62 in order to permit rotation of adjusting nuts 62 and regulation of the meniscus while cover plate 42 is disposed above meniscus regulator system 40. Rotatable advancement of adjusting nuts 62 within meniscus regulator 40 is provided by applying pressure to the flats of adjusting nuts 62 with a rod (not shown) which may be inserted through openings 44. Thus nuts 62 may be advanced uniformly and simultaneously. Additionally, using this method, pressure plate 70 may be advanced a very small distance at a time thereby allowing very precise placement of pressure plate 70 and very precise adjusting of the meniscus. The transparency of cover plate 42 permits a user of meniscus regulator system 40 to view the adjusting rod and adjusting nuts 62 while performing the adjustment.

While meniscus regulator 40 is shown with two adjusting nuts 62, it will be understood that other configurations, for example with four adjusting nuts 62, are possible. Furthermore it will be understood that any manner of advancing plate 70 by applying substantially uniform pressure to it may be used when practicing the method of the present invention. For example, the two or four adjusting nuts 62 may be geared to a knob (not shown) or to each other so that the turning of a single structure advances all adjusting nuts 62 simultaneously.

High velocity droplet meniscus regulator system 40 is then prepared for the firing of water droplet 12. Right up until the firing of high velocity water droplet 12, adjusting nuts 62 may be turned again by applying pressure to them with adjusting rods inserted through holes 44 in transparent cover plate 42. Thus projectile 32 may be fired at a time when an exactly adjusted meniscus is observed. The simultaneous observation of a magnified image of water droplet 12 at liquid jet nozzle 14 through optical viewing system 88 and firing of projectile 32 is thus possible in system 40. This ability permits the user of meniscus regulator system 40 to detect a problem which causes lack of repeatability in these experiments. This factor is a leaking seal around gasket 22. Viewing the meniscus of water droplet 12 while advancing pressure plate 70 allows the observation of rapidly receding water droplets 12 which indicates this gasket problem.

Adjusting nuts 62 are adjusted until the required curvature in the meniscus of water droplet 12 is observed using the magnification of boroscope 80. Projectile 32 is then fired toward metal block 28 in order to force water droplet 12 having the required meniscus curvature to exit meniscus regulator system 40 at a high velocity. Barrel. 75 having internal conduit 77 may be provided to apply the projectile 32 to meniscus regulator system 40. Both pressure plate 70 and support plate 76 are provided with openings 74. Openings 74 are positioned in the pathway of projectile 32 and are large enough to permit projectile 32 to pass therethrough.

Within meniscus regulator system 40 the position of metal block 28 is precisely controlled in order to properly align it with steel cylinder 24. Additionally, the pressure of the water within impact water chamber 20 and liquid jet nozzle 14 is precisely regulated to provide optimum droplet 12. The positive pressure within liquid jet nozzle 14 which is maintained by meniscus regulator system 40 is effective to provide a consistent transfer of energy from energy transfer metal block 28 and steel cylinder 24 to water droplet 12.

The shape of the meniscus on water droplet 12 may be adjusted continuously until immediately before firing of projectile using meniscus regulator system 40. The use of elastic support member 50 to support steel cylinder 24 in meniscus regulator system 40 permits a consistent and accurate positioning of the depth of steel cylinder 24 or steel piston 24 into impact water chamber 20.

Thus, high velocity droplet meniscus regulator system 40 of the present invention is effective to regulate and maintain the optimum curvature in the meniscus of water droplet 12 protruding from liquid jet nozzle 14 of chamber 20 prior to firing of projectile 32. Additionally, meniscus regulator system 40 is able to maintain positive contact between energy transfer metal block 28 and steel piston 24 up until the time of firing of projectile 32. This results in a more consistent and precise control of the size, shape, and velocity of water droplet 12 when water droplet 12 is fired from liquid jet nozzle 14.

Because the transit time of water droplet 12 is controlled by controlling the velocity, the time which gravity operates upon water droplet 12 is more constant within meniscus regulator system 40. It is therefore believed that the placement of water droplet 12 upon the surface of the material being tested to be more precise within system 40. Compressed gas, such as nitrogen, may be used to fire projectile 32. In this manner the pressure firing projectile 32 may be precisely regulated.

More precise control of these parameters provides more reliable impacts of high velocity droplets 12 upon the surface of the material being tested for erosion due to high velocity impacts with water droplets. In tests performed using meniscus regulator system 40, the standard deviation of the velocity of water droplets 12 at impact with a material being tested was observed to decrease from approximately seven percent to approximately three percent.

Figure 6:
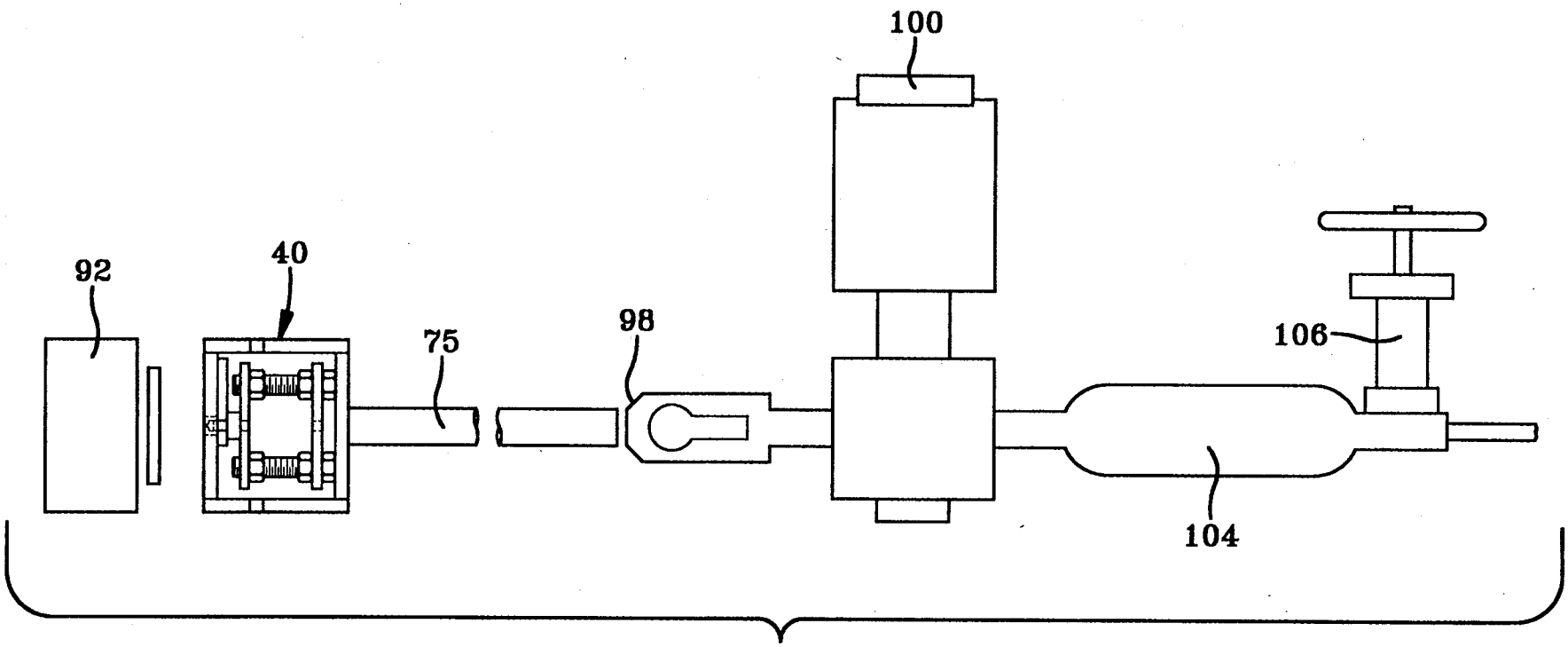
FIG. 6 is a schematic representation of a test system including the miniscus regulator system of the present invention.

Referring now to FIG. 6, there is shown a schematic representation of a test system including meniscus regulator system 40 of the present invention. In this system supply valve 106 provides a gas to gas reservoir 104. Solenoid valve 100 permits a precisely controlled volume and pressure of gas to be applied to projectile 32 which may be inserted into barrel 75 by way of breech 98.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for regulating the meniscus of a water droplet in a high velocity water droplet apparatus having an energy source for applying energy to said water droplet to propel said water droplet at a high velocity, comprising the steps of:

(a) determining shape of said meniscus in accordance with a predetermined shape;

(b) adjusting the shape of said meniscus in accordance with said predetermined shape of step (a) in order to obtain a desired shape for said miniscus; and (c) applying said energy to said water droplet substantially simultaneously with the obtainment of said desired shape of step (b).

2. The method for regulating the :meniscus of claim 1, wherein step (b) comprises advancing said water droplet.

3. The method for regulating the meniscus of claim 1, wherein step (b) comprises applying pressure to said water droplet.

4. The method for regulating the meniscus of claim 1, wherein step (b) comprises applying a pressure device.

5. The method for regulating the meniscus of claim 1, wherein step (b) is followed by the step of further determining the desired shape of the meniscus and further adjusting the shape of meniscus in accordance with the further determining.

6. The method for regulating the meniscus of claim 1, wherein step (a) is performed in accordance with a magnified image of said meniscus.

7. The method of claim 1, wherein said energy source comprises a high velocity projectile.

8. A method for regulating the meniscus of a water droplet in a high velocity water droplet apparatus having an energy source for applying energy to said water droplet to propel said water droplet at a high velocity, comprising the steps of:

(a) providing a magnified image of said water droplet;

(b) adjusting said meniscus in accordance with said magnified image in accordance with a predetermined shape in order to obtain a desired shape of said meniscus; and (c) applying said energy in accordance with said adjusting after said desired shape is obtained.

9. The method for regulating the meniscus of claim 8, wherein step (a) is performed by means of a boroscope.

10. The method for regulating the meniscus of claim 8, wherein step (b) comprises applying pressure to said water droplet.

11. The method for regulating the meniscus of claim 8, wherein said energy is applied to said water droplet simultaneously with said obtainment of said desired shape of step (b).

12. The method for regulating the meniscus of claim 8, wherein said energy source comprises a high velocity projectile.

13. A high velocity water droplet meniscus regulator system, comprising:

(a) a high energy projectile;

(b) an energy transfer body for transferring energy from said projectile to said water droplet;

(c) a pressure adjustment device for adjusting pressure applied to said water droplet to adjust said miniscus; and (d) a system for permitting observation of said adjusted meniscus.

14. The high velocity water droplet meniscus regulator system of claim 13, is applied to said energy transfer body by way of a conduit through a barrel.

15. The high velocity water droplet meniscus regulator of claim 13 wherein said energy transfer body comprises a metal block.

16. The high velocity water droplet meniscus regulator system of claim 13, wherein said pressure adjustment device comprises an advancing device.

17. The high velocity water droplet meniscus regulator of claim 16, wherein said advancing device comprises a threadably advancing device.

18. The high velocity water droplet meniscus regulator system of claim 13, wherein said observation system comprises a boroscope.

19. The high velocity water droplet meniscus regulator system of claim 13, wherein said pressure adjustment device comprises means for adjusting said meniscus in response to said observation.

20. The high velocity water droplet meniscus regulator system of claim 13, wherein said pressure adjustment device comprises means for adjusting said meniscus while applying said high energy projectile to said energy transfer body.

* * * * *